US011920280B2

(12) United States Patent
Leibman et al.

(10) Patent No.: US 11,920,280 B2
(45) Date of Patent: Mar. 5, 2024

(54) WASHING MACHINE APPLIANCE AND SCENT-INFUSING ASSEMBLY

(71) Applicant: Haier US Appliance Solutions, Inc., Wilmington, DE (US)

(72) Inventors: Alexander B. Leibman, Prospect, KY (US); Anburaj Ravikumar, Tamilnadu (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/686,821

(22) Filed: Mar. 4, 2022

(65) Prior Publication Data

US 2023/0279605 A1 Sep. 7, 2023

(51) Int. Cl.

| | |
|---|---|
| ***D06F 39/02*** | (2006.01) |
| ***D06F 23/04*** | (2006.01) |
| ***D06F 37/24*** | (2006.01) |
| ***D06F 37/26*** | (2006.01) |
| ***D06F 37/28*** | (2006.01) |

(52) U.S. Cl.

CPC ..... *D06F 39/02* (2013.01); *D06F 23/04* (2013.01); *D06F 37/24* (2013.01); *D06F 37/267* (2013.01); *D06F 37/28* (2013.01)

(58) Field of Classification Search

None

See application file for complete search history.

(56) References Cited

U.S. PATENT DOCUMENTS

| | | | | |
|---|---|---|---|---|
| 3,066,520 | A | 12/1962 | Jennings | |
| 3,188,146 | A | 6/1965 | Cordes | |
| 6,363,562 | B1 | 4/2002 | Bruntz | |
| 8,573,009 | B2 | 2/2013 | Ekbundit et al. | |
| 8,839,647 | B2 | 9/2014 | Kappler et al. | |
| 2013/0042656 | A1* | 2/2013 | Ekbundit | D06F 39/008 68/5 C |
| 2013/0192084 | A1 | 8/2013 | Hill et al. | |
| 2014/0352364 | A1* | 12/2014 | Martinez Villarreal | D06F 39/028 68/17 R |
| 2018/0298543 | A1* | 10/2018 | Beaudreault | D06F 37/04 |
| 2019/0226138 | A1 | 7/2019 | Tartuferi et al. | |
| 2020/0131687 | A1* | 4/2020 | Wright | D06F 39/022 |

FOREIGN PATENT DOCUMENTS

| | | | |
|---|---|---|---|
| CN | 202107903 | U | 1/2012 |
| CN | 208266481 | U | 12/2018 |
| CN | 209958080 | U | 1/2020 |
| EP | 0391087 | A1 | 10/1990 |
| JP | 2008073127 | A | 4/2008 |
| WO | WO2020083085 | A1 | 4/2020 |

* cited by examiner

*Primary Examiner* — Cristi J Tate-Sims

(74) *Attorney, Agent, or Firm* — Dority & Manning, P.A.

(57) ABSTRACT

A washing machine appliance may include a cabinet, a tub, a wash basket, a plurality of rotatable blades, and an infuser basket. The cabinet may define an opening. The tub may be disposed within the cabinet. The wash basket may be rotatably mounted within the tub to rotate about a rotation axis. The plurality of rotatable blades may be attached to the wash basket to generate a vortex airflow within the cabinet. The infuser basket may define an infuser compartment to hold a scent additive therein. The infuser basket may further defining a plurality of slots to permit the vortex airflow to flow through the infuser compartment within the cabinet.

20 Claims, 7 Drawing Sheets

WASHING MACHINE APPLIANCE AND SCENT-INFUSING ASSEMBLY

FIELD OF THE INVENTION

The present subject matter relates generally to washing machine appliances and more particularly to scent-infusing additive assemblies for washing machine appliances.

BACKGROUND OF THE INVENTION

Washing machine appliances generally include a tub for containing water or wash liquid (e.g., water and detergent, bleach, or other wash additives). A basket is rotatably mounted within the tub and defines a wash chamber for receipt of articles for washing. During normal operation of such washing machine appliances, the wash liquid is directed into the tub and onto articles within the wash chamber of the basket. The basket or an agitation element can rotate at various speeds to agitate articles within the wash chamber, to wring wash fluid from articles within the wash chamber, etc.

In some instances, it may be desirable to provide certain objects or fluids for the aiding or enhancing the wash of articles within a dryer appliance. For instance, some users may desire additional scent modification of washed articles (e.g., beyond what is provided by traditional detergents or fabric softeners). To this end, some users may add concentrated scent pellets or oils to the basket for each new wash load. Such pellets often dissolve with water within the wash basket.

Difficulties and shortcomings exist with these existing approaches. For instance, a user is required to remember to supply pellets with each wash load. It may be difficult to know the correct or effective quantity of pellets to add for a given load. However, providing a separate measuring and dispensing assembly may increase cost and complexity of the system. Additionally, performance of the scent pellets may be compromised or hindered by the one or more rinse cycles of a single washing operation, which can, in effect, wash away the scent pellets and dilute the effects thereof.

Accordingly, a washing machine appliance having an additive assembly for delivering certain additives affecting the smell or performance of fabrics would be desirable. More particularly, an additive dispensing assembly that provides a suitable additive over multiple loads (e.g., without requiring multiple moving parts or without diluting the additive through a rinse cycle) would be especially desirable.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a washing machine appliance is provided. The washing machine appliance may include a cabinet, a tub, a wash basket, a plurality of stationary vanes, a plurality of rotatable blades, and an infuser basket. The cabinet may define an opening. The tub may be disposed within the cabinet. The wash basket may be rotatably mounted within the tub to rotate about a rotation axis. The plurality of stationary vanes may be attached to the tub. The plurality of rotatable blades may be attached to the tub to generate a vortex airflow with the plurality of stationary vanes. The infuser basket may define an infuser compartment to hold a scent additive therein. The infuser basket may further define a plurality of slots to permit the vortex airflow to flow through the infuser compartment within the cabinet.

In another exemplary aspect of the present disclosure, a washing machine appliance is provided. The washing machine appliance may include a cabinet, a tub, a wash basket, a plurality of rotatable blades, and an infuser basket. The cabinet may include a top cover defining an opening. The tub may be disposed within the cabinet. The wash basket may be rotatably mounted within the tub to rotate about a rotation axis. The plurality of rotatable blades may be attached to the wash basket to generate a vortex airflow within the cabinet. The infuser basket may be radially spaced apart from the tub on the top cover. The infuser basket may define an infuser compartment to hold a scent additive therein. The infuser basket may further defining a plurality of slots to permit the vortex airflow to flow through the infuser compartment within the cabinet.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
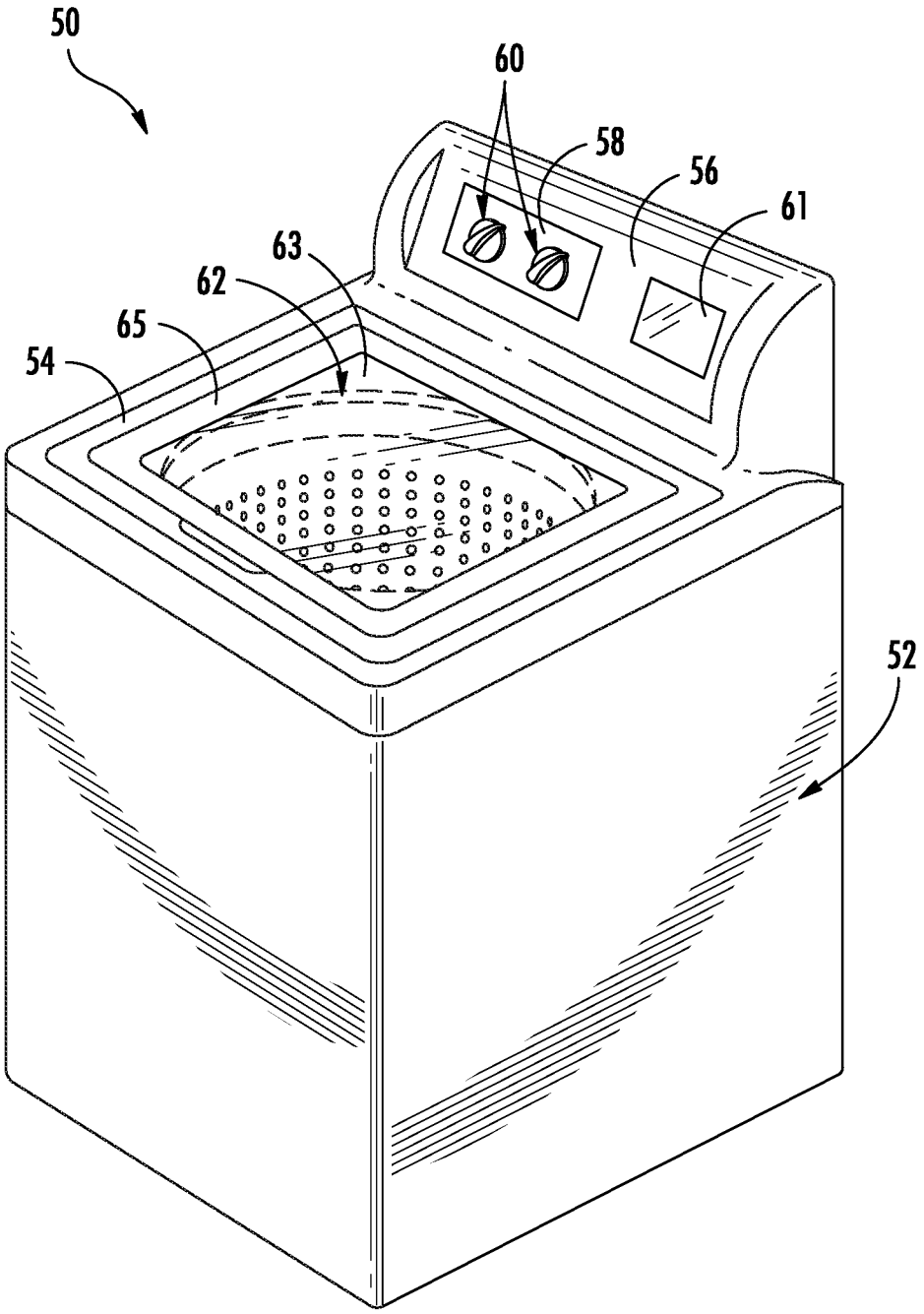
FIG. 1 provides a perspective appliance view of a washing machine appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
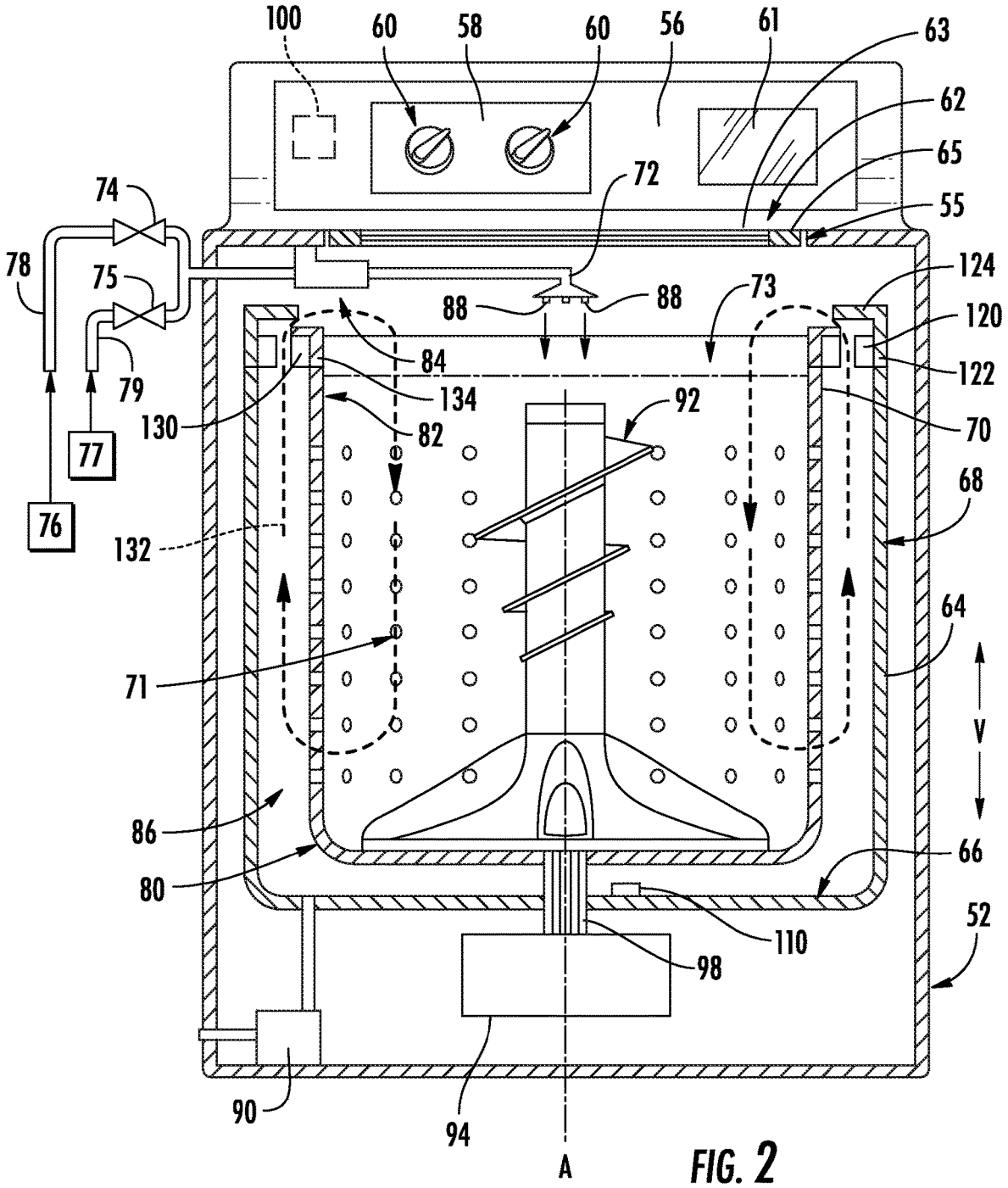
FIG. 2 provides a schematic elevation view of the exemplary washing machine appliance of FIG. 1.
Figure 3:
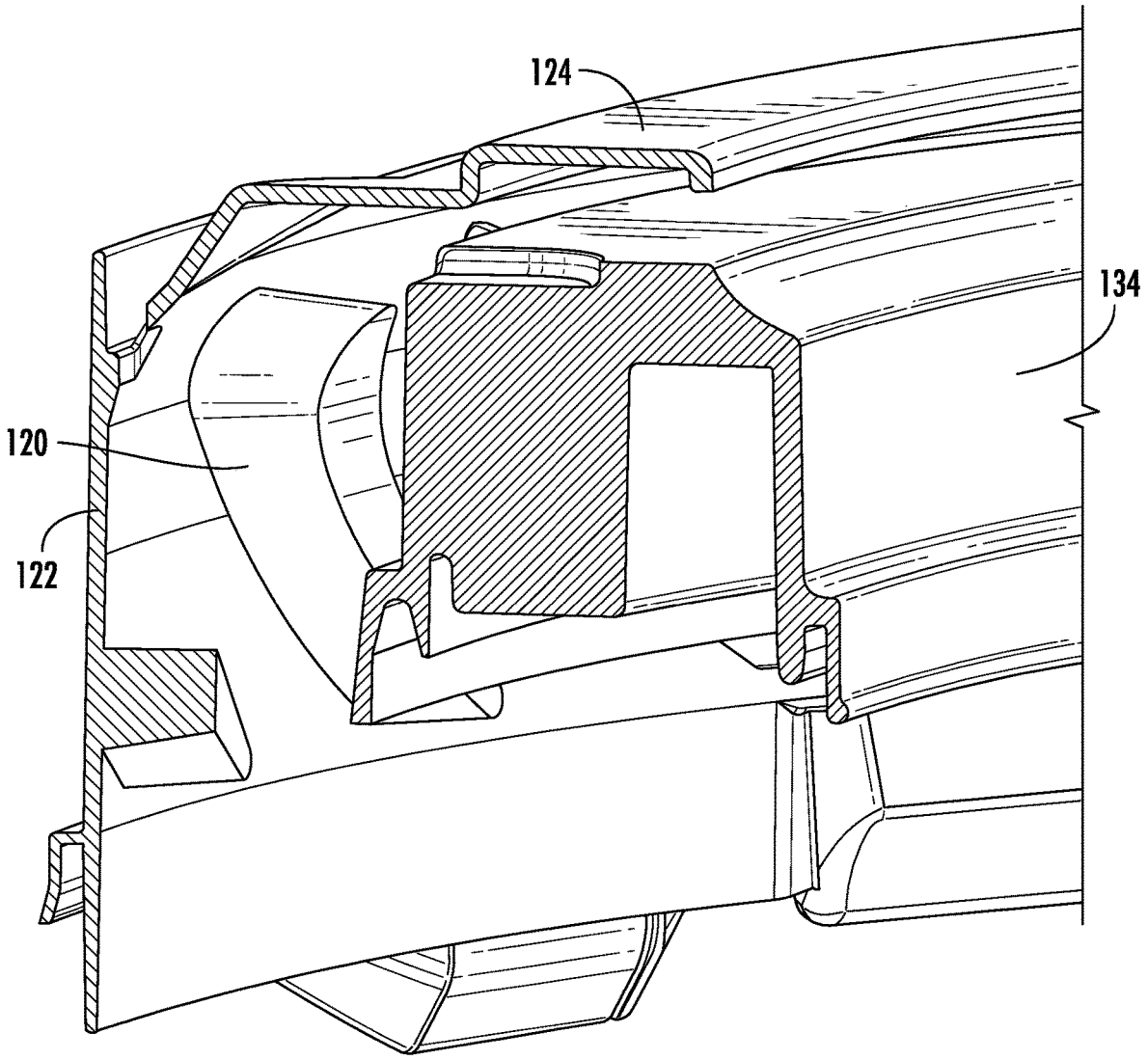
FIG. 3 provides a perspective cross-sectional view of a tub cover and balance ring of a washing machine appliance according to exemplary embodiments of the present disclosure.
Figure 4:
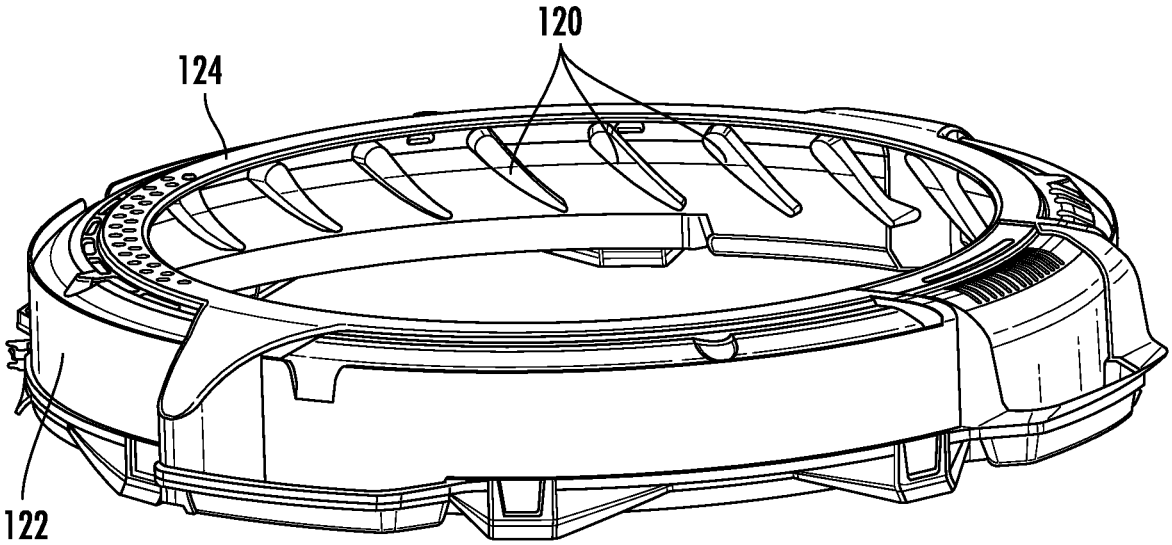
FIG. 4 provides a perspective view of a tub cover of a washing machine appliance according to exemplary embodiments of the present disclosure.
Figure 5:
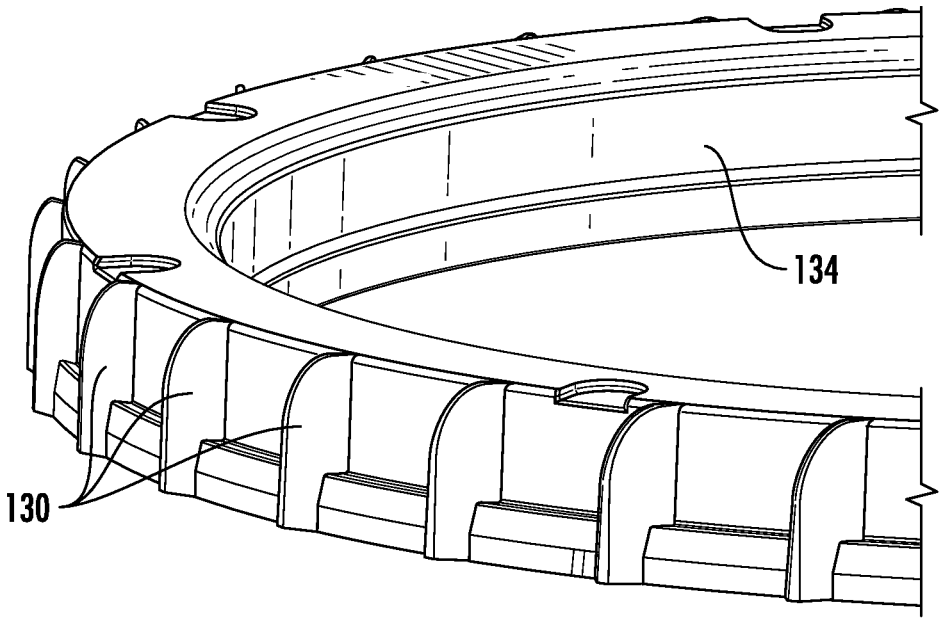
FIG. 5 provides a perspective view of a balance ring of a washing machine appliance according to exemplary embodiments of the present disclosure.
Figure 6:
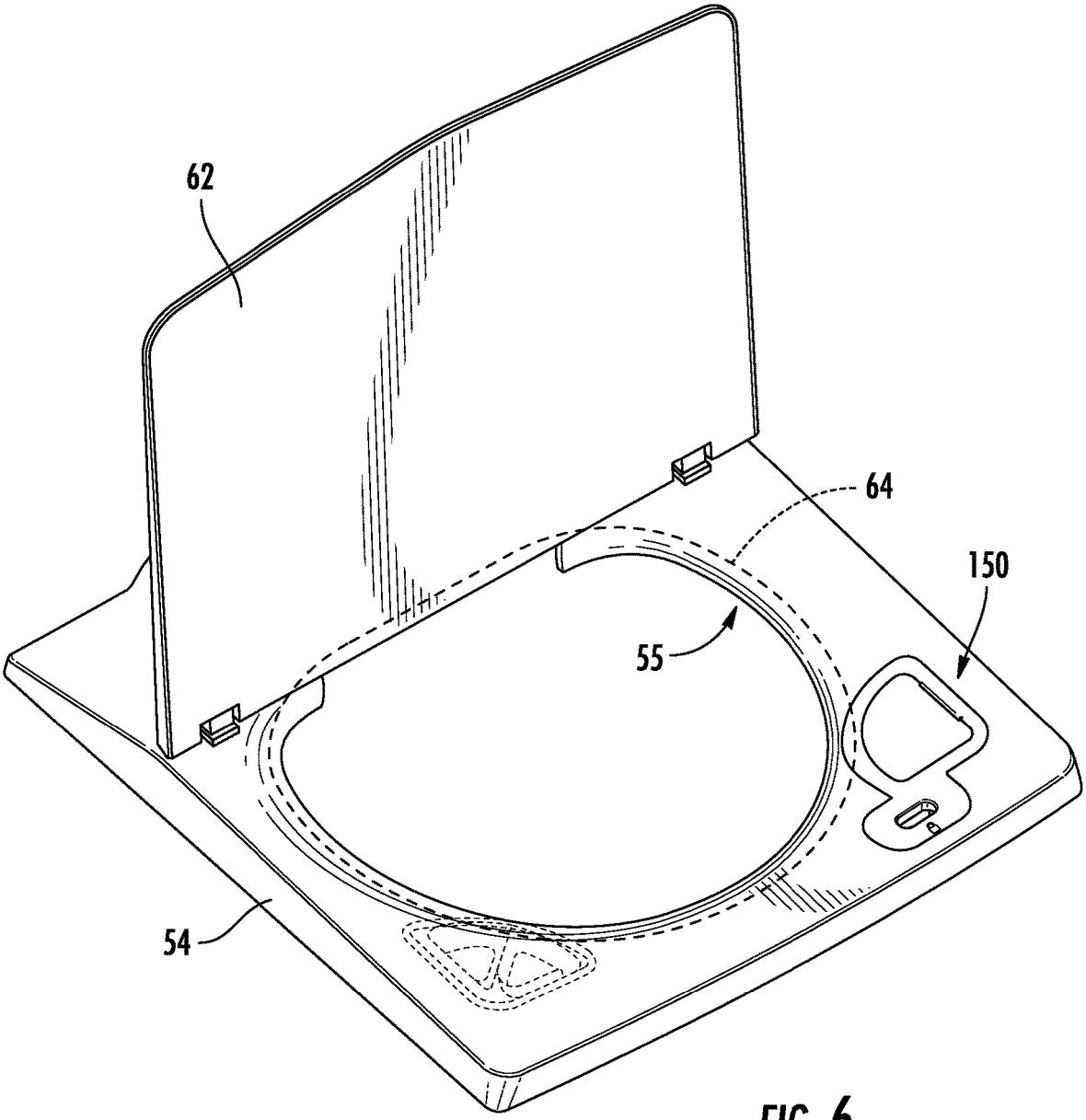
FIG. 6 provides a perspective view of a top cover of a cabinet of a washing machine appliance, including an infusion compartment, according to exemplary embodiments of the present disclosure.
Figure 7:
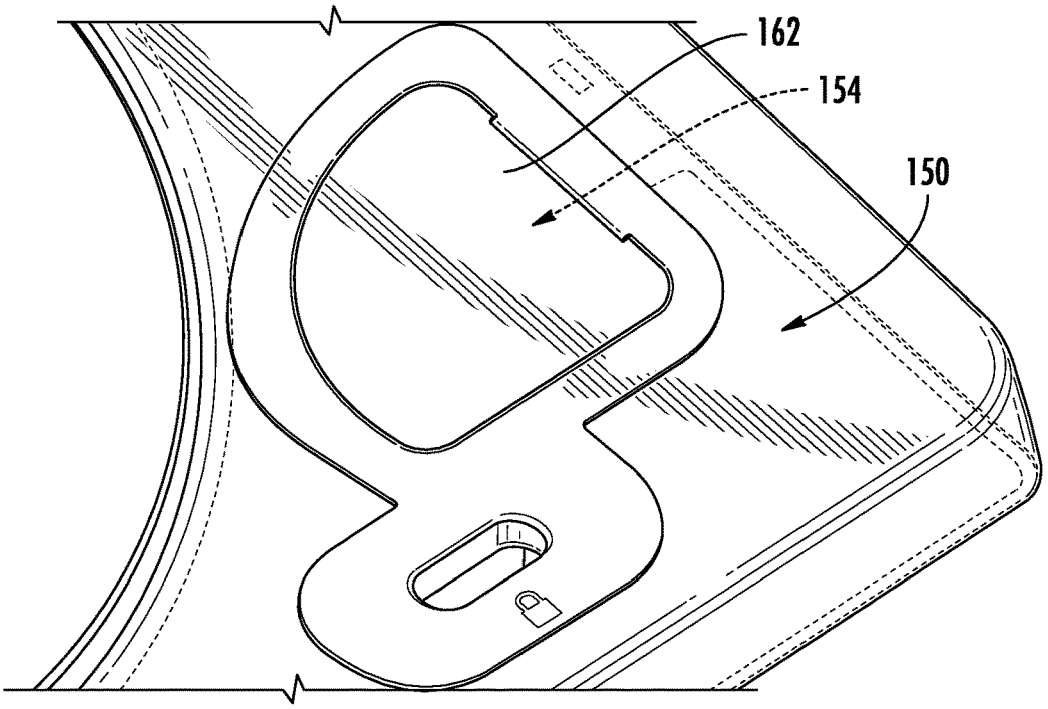
FIG. 7 provides a magnified perspective view of the infusion compartment of the exemplary top cover of FIG. 6, wherein a lid compartment is in a closed position.

Turning now to the figures, FIGS. 1 and 2 provide separate views of a washing machine appliance 50 according to exemplary embodiments of the present disclosure. As shown, washing machine appliance 50 generally defines a vertical direction V, a lateral direction L, and a transverse direction T. The vertical direction V, lateral direction L, and transverse direction T are each mutually perpendicular and form an orthogonal direction system.

Washing machine appliance 50 may include a cabinet 52 having a top cover 54 that defines a vertical primary opening 55. A backsplash 56 extends from cover 54, and a control panel 58, including a plurality of input selectors 60, is coupled to backsplash 56.

Control panel 58 and input selectors 60 collectively form a user interface input for operator selection of machine cycles and features, and in one embodiment, a display 61 indicates selected features, a countdown timer, or other items of interest to machine users. It should be appreciated, however, that in other exemplary embodiments, the control panel 58, input selectors 60, and display 61, may have any other suitable configuration. For example, in other exemplary embodiments, one or more of the input selectors 60 may be configured as manual "push-button" input selectors, or alternatively may be configured as a touchscreen (e.g., on display 61).

A lid 62 may be mounted to cover 54 and rotatable between an open position (not shown) facilitating access to a tub, also referred to as a wash tub 64, located within cabinet 52 (e.g., via the primary opening 55) and a closed position (FIG. 1) forming an enclosure over tub 64. Lid 62 in exemplary embodiment includes a transparent panel 63, which may be formed of, for example, glass, plastic, or any other suitable material. The transparency of the panel 63 allows users to see through the panel 63, and into the tub 64 when the lid 62 is in the closed position. In some embodiments, the panel 63 itself can generally form the lid 62. In other embodiments, the lid 62 includes the panel 63 and a frame 65 surrounding and encasing the panel 63. Alternatively, panel 63 need not be transparent.

As may be seen in FIG. 2, tub 64 includes a bottom wall 66 and a sidewall 68. A wash drum or basket 70 is rotatably mounted within tub 64. In particular, basket 70 is rotatable about a central axis, which may when properly balanced and positioned in the embodiment illustrated be a vertical axis. Thus, washing machine appliance is generally referred to as a vertical axis washing machine appliance. Basket 70 defines a wash chamber 73 for receipt of articles for washing and extends, for example, vertically, between a bottom portion 80 and a top portion 82. Basket 70 includes a plurality of openings or perforations 71 therein to facilitate fluid communication between an interior of basket 70 and tub 64.

A nozzle 72 is configured for flowing a liquid into tub 64. In particular, nozzle 72 may be positioned at or adjacent to top portion 82 of basket 70. Nozzle 72 may be in fluid communication with one or more water sources 76, 77 in order to direct liquid (e.g. water) into tub 64 or onto articles within chamber 73 of basket 70. Nozzle 72 may further include apertures 88 through which water may be sprayed into the tub 64. Apertures 88 may, for example, be tubes extending from the nozzles 72 as illustrated, or simply holes defined in the nozzles 72 or any other suitable openings through which water may be sprayed. Nozzle 72 may additionally include other openings, holes, etc. (not shown) through which water may be flowed (i.e., sprayed or poured) into the tub 64.

Various valves may regulate the flow of fluid through nozzle 72. For example, a flow regulator may be provided to control a flow of hot or cold water into the wash chamber of washing machine appliance 50. For the embodiment depicted, the flow regulator includes a hot water valve 74 and a cold water valve 75. The hot and cold water valves 74, 75 are used to flow hot water and cold water, respectively, therethrough. Each valve 74, 75 can selectively adjust to a closed position in order to terminate or obstruct the flow of fluid therethrough to nozzle 72. The hot water valve 74 may be in fluid communication with a hot water source 76, which may be external to the washing machine appliance 50. The cold water valve 75 may be in fluid communication with a cold water source 77, which may be external to the washing machine appliance 50. The cold water source 77 may, for example, be a commercial water supply, while the hot water source 76 may be, for example, a water heater. Such water sources 76, 77 may supply water to the appliance 50 through the respective valves 74, 75. A hot water conduit 78 and a cold water conduit 79 may supply hot and cold water, respectively, from the sources 76, 77 through the respective valves 74, 75 and to the nozzle 72.

An additive dispenser 84 may additionally be provided for directing a wash additive, such as detergent, bleach, liquid fabric softener, etc., into the tub 64. For example, dispenser 84 may be in fluid communication with nozzle 72 such that water flowing through nozzle 72 flows through dispenser 84, mixing with wash additive at a desired time during operation to form a liquid or wash fluid, before being flowed into tub 64. For the embodiment depicted, nozzle 72 is a separate downstream component from dispenser 84. In other exemplary embodiments, however, nozzle 72 and dispenser 84 may be integral, with a portion of dispenser 84 serving as the nozzle 72, or alternatively dispenser 84 may be in fluid communication with only one of hot water valve 74 or cold water valve 75. In still other exemplary embodiments, the washing machine appliance 50 may not include a dispenser, in which case a user may add one or more wash additives directly to wash chamber 73. A pump assembly 90 (shown schematically in FIG. 2) is located beneath tub 64 and basket 70 for gravity assisted flow to drain tub 64.

A known agitation element 92, such as a vane agitator, impeller, auger, or oscillatory basket mechanism, or some combination thereof is disposed in basket 70 and oriented to rotate about the rotation axis A (e.g., parallel to the vertical direction V), thereby imparting an oscillatory motion to articles and liquid in basket 70. In different embodiments, agitation element 92 may be a single action element (i.e., oscillatory only), double action (oscillatory movement at one end, single direction rotation at the other end) or triple action (oscillatory movement plus single direction rotation at one end, singe direction rotation at the other end).

In optional embodiments, basket 70 and agitation element 92 are both driven by a motor 94. Motor 94 may, for example, be a pancake motor, direct drive brushless motor, induction motor, or other motor suitable for driving basket 70 and agitation element 92. As motor output shaft 98 is rotated, basket 70 and agitation element 92 are operated for rotatable movement within tub 64 (e.g., about rotation axis A). Washing machine appliance 50 may also include a brake assembly (not shown) selectively applied or released for respectively maintaining basket 70 in a stationary position within tub 64 or for allowing basket 70 to spin within tub 64.

Operation of washing machine appliance 50 is controlled by a processing device or controller 100, that is operatively coupled to the input selectors 60 located on washing machine backsplash 56 for user manipulation to select washing machine cycles and features. Controller 100 may further be operatively coupled to various other components of appliance 50, such as the flow regulator (including valves 74, 75), motor 94, pressure sensor 110, other suitable sensors, etc. In response to user manipulation of the input selectors 60, controller 100 may operate the various components of washing machine appliance 50 to execute selected machine cycles and features.

While described in the context of specific embodiments of washing machine appliance 50, using the teachings disclosed herein it will be understood that washing machine appliance 50 is provided by way of example only. Other washing machine appliances having different configurations, different appearances, or different features may also be used with the present subject matter as well.

Turning now generally to FIGS. 2 through 5, various portions at or adjacent to the tub 64 and wash basket 70 will be described in detail. As shown, a plurality of stationary vanes 120 may be provided. In particular, a plurality of stationary vanes 120 may be attached to the tub 64 and, thus, remain static or stationary even as the wash basket 70 rotates. In some embodiments, the plurality of stationary vanes 120 extend radially inward (e.g., toward rotation axis A). Each of the plurality of stationary vanes 120 may be circumferentially spaced apart. Thus, each of the plurality of vanes may extend radially inward at a discrete circumferential location about the tub 64. In particular, a fixed end proximal to the tub 64 may be held at an outer location while a radially inward free end distal to the tub 64 may be held within the annular space 86 between the tub 64 and wash basket 70. Although the stationary vanes 120 may be circumferentially spaced apart from each other, each may be held or mounted at a common height (e.g., in parallel relative to the vertical direction V).

In certain embodiments, the plurality of stationary vanes 120 are located proximal to the top end of tub 64 (i.e., distal to the bottom end or wall 66 of tub 64). Thus, the plurality to the stationary vanes 120 may be closer to the top end of the tub 64 than the bottom end or wall 66 of the tub 64 (e.g., relative to the vertical direction V). Optionally, the stationary vanes 120 may be located at the top end of tub 64. For instance, the stationary vanes 120 may be fixed to (e.g., formed on) a molded tub cover 122 attached to tub 64. As shown, molded tub cover 122 may have a upper lip 124 that ends radially inward (e.g., above stationary vanes 120), such as to prevent water or wash fluid spilling outside of tub 64.

In optional embodiments, the plurality of stationary vanes 120 are each formed as discrete airfoils. Such airfoils may be curved (e.g., concave at the pressure side), as shown. Additionally or alternatively, the leading edge of each vane may be held above the trailing edge. Thus, the point of maximum curvature may be located at a higher point relative to the vertical direction V, and closer to the primary opening 55, than the point of minimum curvature. Nonetheless, except as otherwise indicated, stationary vanes 120 are not limited to any particular shape or configuration of the stationary vanes 120.

Separate from or in addition to the stationary vanes 120, a plurality of rotatable blades 130 are attached to the wash basket 70 (e.g., directly or indirectly) and, thus, rotate or oscillate with wash basket 70 about rotation axis A (e.g., during an agitation, wash, or spin cycle). As will be described in detail below, such rotation of the rotatable blades 130 may generate a vortex airflow 132. In some embodiments, the plurality of rotatable blades 130 extend radially outward (e.g., away from rotation axis A). Each of the plurality of rotatable blades 130 may be circumferentially spaced apart. Thus, each of the rotatable blades 130 may extend radially outward at a discrete circumferential location about the wash basket 70. In particular, a fixed end proximal to the wash basket 70 may be held at an inner location while a radially outward free end distal to the wash basket 70 may be held within the annular space 86 between the tub 64 and wash basket 70. Although the rotatable blades 130 may be circumferentially spaced apart from each other, each blade may be held or mounted at a common height (e.g., in parallel relative to the vertical direction V). Optionally, the rotatable blades 130 may be held at a common vertical height with the stationary vanes 120 (e.g., within the cabinet 52 at the annular space 86).

In certain embodiments, the plurality of rotatable blades 130 are located proximal to the top end of wash basket 70 (i.e., distal to the bottom end or portion 80 of wash basket 70). Thus, the plurality to the rotatable blades 130 may be closer to the top end of the wash basket 70 than the bottom end or portion 80 of the wash basket 70 (e.g., relative to the vertical direction V). Optionally, the rotatable blades 130 may be located at the top end of wash basket 70. For instance, the rotatable blades 130 may be fixed to (e.g., formed on) a balance ring 134 attached to and extending circumferentially around wash basket 70 (e.g., to form or define an opening to the wash basket 70). As would be understood, the balance ring 134 may include features for controlling movement of a fluid in the ring 134 that offsets an imbalance of articles in wash basket 70. Optionally, the balance ring 134 may be a molded plastic component that is fixed to the top end of the wash basket 70, with the rotatable blades 130 being molded directly into an outer circumferential surface of the balance ring 134. Alternatively, the rotatable blades 130 may be separately formed and attached to the balance ring 134.

In optional embodiments, the plurality of rotatable blades 130 are each formed as discrete paddles. Such paddles may be straight (e.g., parallel to the vertical direction V), as shown. Additionally or alternatively, a curved or beveled edge of each blade may be held above a straight or right-angle edge. Thus, each blade may be tapered or beveled closer to the primary opening 55, than the edge that is distal to the primary opening 55. Nonetheless, except as otherwise indicated, rotatable blades 130 are not limited to any particular shape or configuration of the rotatable blades 130.

As the wash basket 70 (and, thus, the plurality of rotatable blades 130) rotates, a vortex airflow 132 may be generated within the cabinet 52. Specifically, the pressure generated by rotation of the blades (e.g., in conjunction with the stationary vanes 120) may draw air from the wash basket 70 and the open regions within the cabinet 52. Such air may then be forced to the wash chamber 73. For instance, the vortex airflow 132 may be drawn downward in the vertical direction V, as depicted by the dashed flow lines in FIG. 2. The vortex airflow 132 may be circulated through perforations in the bottom of the wash basket 70, upwards along the annular space 86, and back into the wash basket 70 through the open top, as depicted in FIG. 2.

Turning now especially to FIGS. 2 and 6 through 9, an exemplary additive assembly 150 will be described in detail. Generally, additive assembly 150 may be provided for supplying or infusing one or more additives to articles within the wash chamber 73 (e.g., separately from or in addition to detergent). As shown, additive assembly 150 may generally include an infuser basket 152 that defines an infuser compartment 154. As will be described in detail below, one or more additives (e.g., scent pellets) may be provided to infuser compartment 154 to treat or affect articles within wash chamber 73 (e.g., in tandem with the vortex airflow 132 as wash basket 70 120 rotates or spins). Generally, the infuser basket 152 is formed with one or more solid wall segments that define a plurality of slots 156. Optionally, such solid wall segments may be parallel slats, as shown. When assembled, an additive (e.g., scent pellets or oils) may be cradled within the infuser compartment 154 (e.g., directly or via a removable additive container 158, such as the mesh ball included in the figures). Nonetheless, air may be permitted to pass through the slots 156.

As shown, the infuser basket 152 is generally surrounded by and in communication with an open area of the cabinet 52. Moreover, the open area (and thus the infuser compartment 154) may be in fluid communication with the annular space 86 and wash basket 70. In turn, the slots 156 may permit the vortex airflow 132 to flow through the infuser compartment 154 within the cabinet 52.

Figure 8:
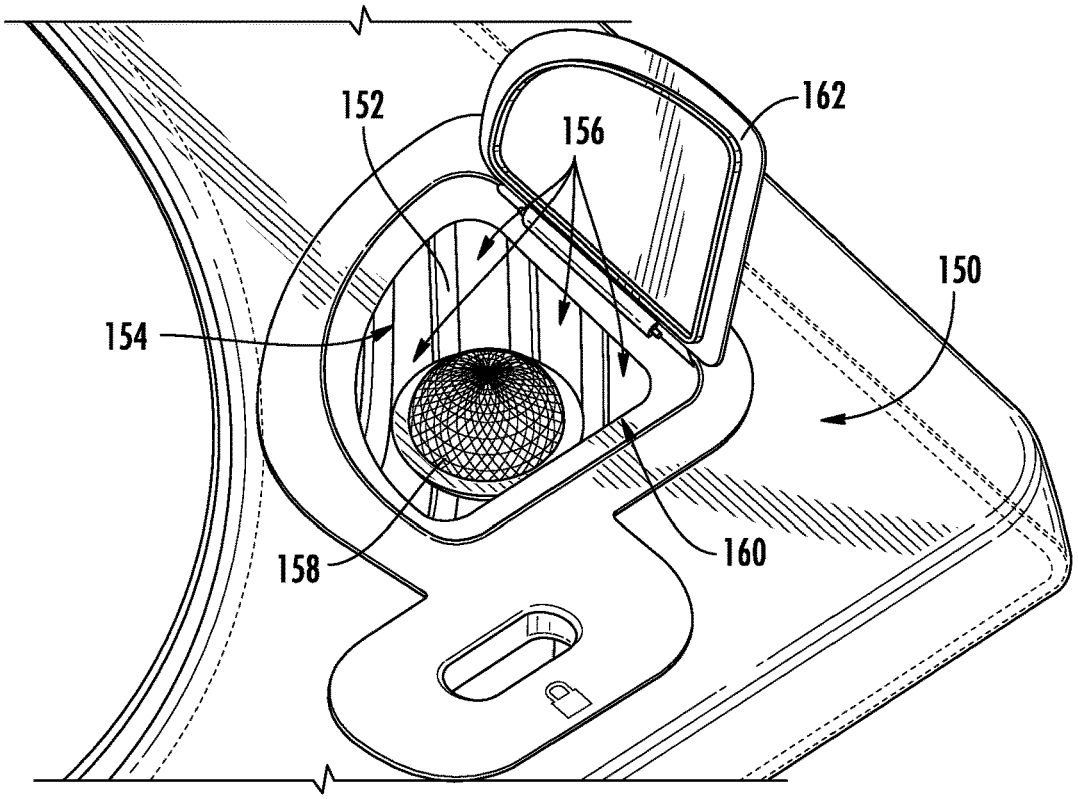
FIG. 8 provides another magnified perspective view of the infusion compartment of the exemplary top cover of FIG. 6, wherein the lid compartment is in an opened position.
Figure 9:
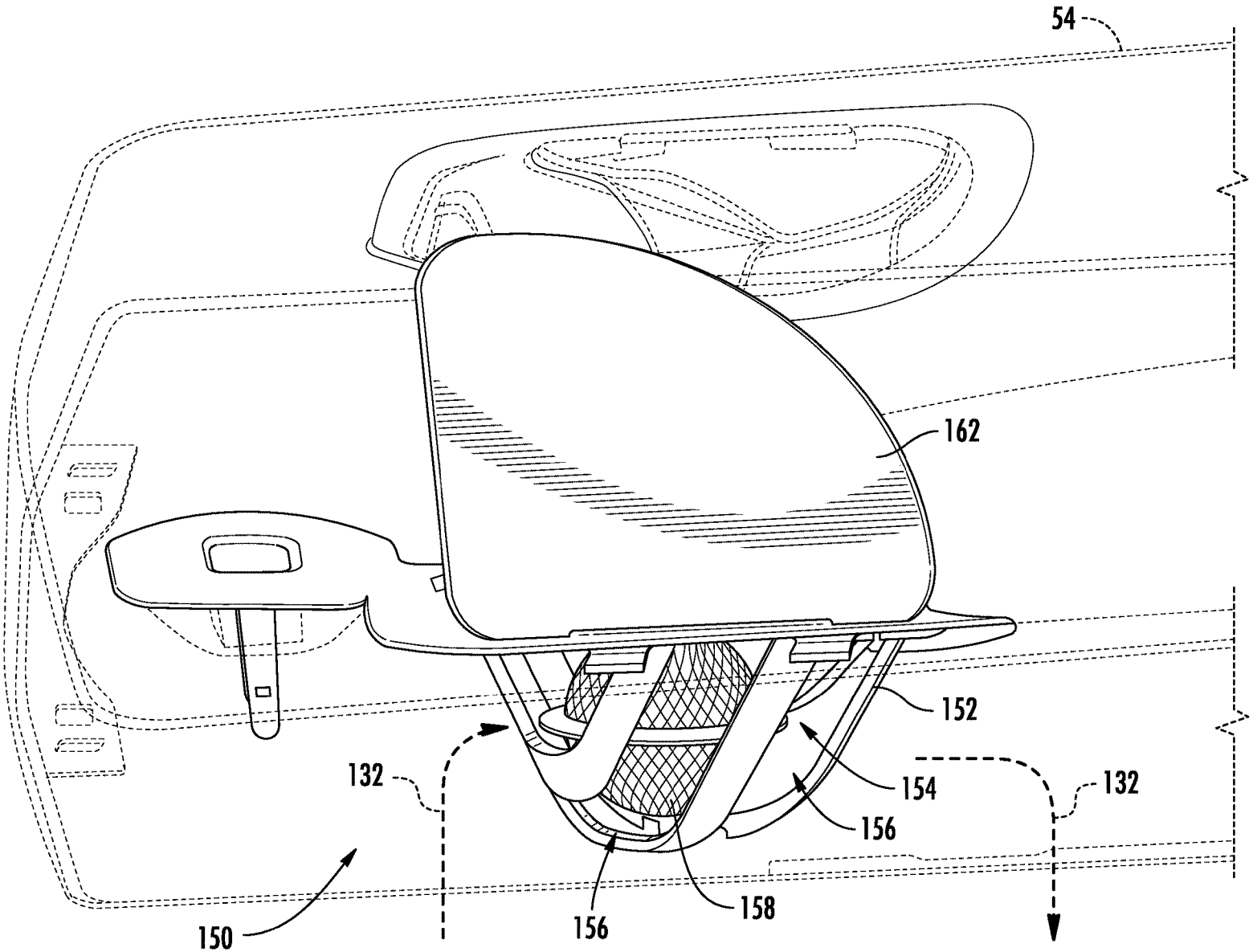
FIG. 9 provides another magnified perspective view of the infusion compartment of the exemplary top cover of FIG. 6, wherein a portion of the top cover has been removed for the sake of clarity.

In some embodiments, the infuser basket 152 is fixed to the top cover 54. Top cover 54 may define a vertical compartment aperture 160 that is directly above the infuser compartment 154 and, thus, permits access to the infuser compartment 154 (e.g., when the lid 62 is open). As shown, the vertical compartment aperture 160 may be radially spaced apart from the primary opening 55. Thus, primary opening 55 and vertical compartment aperture 160 may be discrete and, optionally, parallel openings to inner portions of the cabinet 52. In certain embodiments, a compartment lid 162 is provided to selectively cover the vertical compartment aperture 160. As shown, the compartment lid 162 may be disposed on top cover 54 (e.g., to move relative thereto). For instance, the compartment lid 162 may be pivotably mounted on top cover 54 to rotate between a closed position (FIG. 7) and an open position (FIG. 8).

When assembled, the infuser basket 152 may be held above the tub 64 (e.g., above tub cover 122). Additionally or alternatively, infuser basket 152 may be radially spaced apart from the tub 64. The pressure of the vortex airflow 132 may thus draw air from the region of cabinet 52 surrounding tub 64 and through infuser compartment 154 before flowing to the wash chamber 73. As air flows through the infuser compartment 154, additives within the air-porous additive container 158 or infuser compartment 154 generally may be permitted to infuse the air while remaining held within the infuser compartment 154. Advantageously, the additives may infuse the air without fully dissolving in water. Moreover, the infusion and airflow may notably occur without requiring a separate or dedicated fan or blower. Additionally or alternatively, the infusion and airflow may occur throughout a washing operation or even after a final rinse (e.g., in conjunction with rotation of the wash basket 70), advantageously ensuring the additive remains on the articles following expiration of the wash cycle.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance, comprising:

a cabinet defining an opening;

a tub disposed within the cabinet;

a wash basket rotatably mounted within the tub to rotate about a rotation axis;

a plurality of stationary vanes attached to the tub;

a plurality of rotatable blades attached to the tub to generate a vortex airflow with the plurality of stationary vanes; and an infuser basket defining an infuser compartment to hold a scent additive therein, the infuser basket further defining a plurality of slots to permit the vortex airflow to flow through the infuser compartment within the cabinet, wherein the plurality of stationary vanes and the plurality of rotatable blades are disposed at a common height within the cabinet in parallel relative to a vertical direction.

2. The washing machine appliance of claim 1, wherein the plurality of stationary vanes extend radially inward toward the rotation axis.

3. The washing machine appliance of claim 1, further comprising:

tub cover attached to a top end of the tub, wherein the plurality of stationary vanes are fixed to the tub cover.

4. The washing machine appliance of claim 1, wherein the plurality of stationary vanes and the plurality of rotatable blades are disposed at a common height within the cabinet.

5. The washing machine appliance of claim 1, further comprising:

a balance ring extending circumferentially about the wash basket and attached thereto, wherein the plurality of rotatable blades are fixed to the balance ring.

6. The washing machine appliance of claim 1, wherein the plurality of rotatable blades extend radially outward away from the rotation axis.

7. The washing machine appliance of claim 1, wherein the cabinet comprises a top cover defining the opening along a vertical direction, wherein the infuser basket is fixed to the top cover.

8. The washing machine appliance of claim 7, wherein the top cover defines a vertical compartment aperture directly above the infuser compartment and radially spaced apart from the opening.

9. The washing machine appliance of claim 8, further comprising:

a compartment lid disposed on the top cover and selectively covering the vertical compartment aperture.

10. The washing machine appliance of claim 1, wherein in the infuser basket is radially spaced apart from the tub.

11. The washing machine appliance of claim 1, wherein the infuser basket is disposed above the tub.

12. A washing machine appliance, comprising:

a cabinet comprising a top cover defining an opening;

a tub disposed within the cabinet;

a wash basket rotatably mounted within the tub to rotate about a rotation axis;

a plurality of rotatable blades attached to the wash basket to generate a vortex airflow within the cabinet; and an infuser basket radially spaced apart from the tub on the top cover, the infuser basket defining an infuser compartment to hold a scent additive therein, the infuser basket further defining a plurality of slots to permit the vortex airflow to flow through the infuser compartment within the cabinet, wherein the infuser basket is surrounded by and in communication with an open area of the cabinet such that the vortex airflow can flow directly between the infuser basket and the open area of the cabinet.

13. The washing machine appliance of claim 12, further comprising:

a plurality of stationary vanes attached to the tub, wherein the plurality of stationary vanes extend radially inward toward the rotation axis.

14. The washing machine appliance of claim 12, further comprising:

a plurality of stationary vanes attached to the tub; and tub cover attached to a top end of the tub, wherein the plurality of stationary vanes are fixed to the tub cover.

15. The washing machine appliance of claim 12, further comprising:

a plurality of stationary vanes attached to the tub, wherein the plurality of stationary vanes and the plurality of rotatable blades are disposed at a common height within the cabinet.

16. The washing machine appliance of claim 12, further comprising:

a balance ring extending circumferentially about the wash basket and attached thereto, wherein the plurality of rotatable blades are fixed to the balance ring.

17. The washing machine appliance of claim 12, wherein the plurality of rotatable blades extend radially outward away from the rotation axis.

18. The washing machine appliance of claim 12, wherein the top cover defines a vertical compartment aperture directly above the infuser compartment and radially spaced apart from the opening.

19. The washing machine appliance of claim 18, further comprising:

a compartment lid disposed on the top cover and selectively covering the vertical compartment aperture.

20. The washing machine appliance of claim 12, wherein the infuser basket is disposed above the tub.

* * * * *